US008276386B2

(12) United States Patent
Ziminsky et al.

(10) Patent No.: US 8,276,386 B2
(45) Date of Patent: Oct. 2, 2012

(54) APPARATUS AND METHOD FOR A COMBUSTOR

(75) Inventors: Willy Steve Ziminsky, Greenville, SC (US); Christopher Edward Wolfe, Niskayuna, NY (US); Sergey Anatolievich Meshkov, Moscow (RU); Sergey Adolfovich Oskin, Moscow (RU)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/889,512

(22) Filed: Sep. 24, 2010

(65) Prior Publication Data

US 2012/0073300 A1 Mar. 29, 2012

(51) Int. Cl.
*F02C 7/08* (2006.01)

(52) U.S. Cl. ..... 60/738; 60/39.23

(58) Field of Classification Search ..... 60/39.37, 60/737, 738, 746–748, 752, 39.23; 431/8, 431/159, 174, 278, 285
See application file for complete search history.

(56) References Cited

U.S. PATENT DOCUMENTS

| | | | | | |
|---|---|---|---|---|---|
| 2,655,787 | A | * | 10/1953 | Brown | 60/39.23 |
| 3,267,676 | A | * | 8/1966 | Sueeden | 60/738 |
| 3,930,368 | A | | 1/1976 | Anderson et al. | |
| 3,958,413 | A | | 5/1976 | Cornelius et al. | |
| 4,138,842 | A | * | 2/1979 | Zwick | 60/39.23 |
| 4,150,539 | A | * | 4/1979 | Rubins et al. | 60/39.23 |
| 5,069,029 | A | * | 12/1991 | Kuroda et al. | 60/776 |
| 5,125,227 | A | * | 6/1992 | Ford et al. | 60/39.23 |
| 5,159,807 | A | * | 11/1992 | Forestier | 60/39.23 |
| 5,351,474 | A | | 10/1994 | Slocum et al. | |
| 5,548,951 | A | | 8/1996 | Mumford et al. | |
| 5,557,920 | A | | 9/1996 | Kain | |
| 5,636,510 | A | | 6/1997 | Béer et al. | |
| 5,692,370 | A | | 12/1997 | Stuhlmüller et al. | |
| 5,775,098 | A | | 7/1998 | Philippona | |
| 5,974,781 | A | | 11/1999 | Correa et al. | |
| 6,237,323 | B1 | | 5/2001 | Ojiro et al. | |
| 6,263,663 | B1 | * | 7/2001 | Grienche et al. | 60/794 |
| 6,568,188 | B2 | | 5/2003 | Kolman et al. | |
| 6,860,098 | B2 | | 3/2005 | Suenaga et al. | |
| 6,968,693 | B2 | * | 11/2005 | Colibaba-Evulet et al. | 60/737 |
| 7,096,675 | B2 | | 8/2006 | Jönsson et al. | |
| 7,127,899 | B2 | | 10/2006 | Sprouse et al. | |
| 7,185,494 | B2 | | 3/2007 | Ziminsky et al. | |
| 7,299,618 | B2 | | 11/2007 | Terazaki et al. | |
| 8,037,689 | B2 | * | 10/2011 | Oskin et al. | 60/737 |
| 2003/0167771 | A1 | * | 9/2003 | Hayashi et al. | 60/737 |
| 2006/0010878 | A1 | | 1/2006 | Widener | |
| 2006/0191268 | A1 | | 8/2006 | Widener et al. | |
| 2007/0151257 | A1 | | 7/2007 | Maier et al. | |
| 2008/0016876 | A1 | | 1/2008 | Colibaba-Evulet et al. | |
| 2008/0053097 | A1 | * | 3/2008 | Han et al. | 60/737 |
| 2009/0139237 | A1 | * | 6/2009 | Sullivan et al. | 60/737 |

* cited by examiner

*Primary Examiner* — Phutthiwat Wongwian
(74) *Attorney, Agent, or Firm* — Dority & Manning, P.A.

(57) ABSTRACT

A combustor includes an end cover and a combustion chamber downstream of the end cover. The combustor further includes nozzles disposed radially in the end cover and a shroud surrounding at least one of the nozzles and extending downstream into the combustion chamber. The shroud includes an inner wall surface and an outer wall surface. A method for operating a combustor includes flowing compressed working fluid through nozzles into a combustion chamber, flowing fuel through each nozzle in a first subset of the nozzles into the combustion chamber, and igniting the fuel from each nozzle in the first subset of nozzles in the combustion chamber. In addition, the method includes extending into the combustion chamber a separate shroud around each nozzle in a second subset of the nozzles and isolating fuel to each nozzle in the second subset of nozzles.

18 Claims, 4 Drawing Sheets

APPARATUS AND METHOD FOR A COMBUSTOR

FIELD OF THE INVENTION

The present invention generally involves a combustor for a gas turbine. Specifically, the present invention describes and enables a combustor with multiple fuel nozzles that can operate in various turndown regimes to reduce fuel consumption.

BACKGROUND OF THE INVENTION

Gas turbines are widely used in commercial operations for power generation. A gas turbine compresses ambient air, mixes fuel with the compressed air, and ignites the mixture to produce high energy combustion gases that flow through a turbine to produce work. The turbine may drive an output shaft connected to a generator to produce electricity which is then supplied to a power grid. The turbine and generator must operate at a relatively constant speed, regardless of the amount of electricity being generated, to produce electricity at a desired frequency.

Gas turbines are typically designed to operate most efficiently at or near the designed base load. However, the power demanded of the gas turbine may often be less than the designed base load. For example, power consumption, and thus demand, may vary over the course of a season and even over the course of a day, with reduced power demand common during nighttime hours. Continuing to operate the gas turbine at its designed base load during low demand periods wastes fuel and generates excessive emissions.

One alternative to operating the gas turbine at base load during low demand periods is to simply shut down the gas turbine and start it back up once the power demand increases. However, starting up and shutting down the gas turbine creates large thermal stresses across many components that lead to increased repairs and maintenance. Moreover, gas turbines are often operated with additional auxiliary equipment in a combined cycle system. For example, a heat recovery steam generator may be connected to the turbine exhaust to recover heat from the exhaust gases to increase the overall efficiency of the gas turbine. Shutting down the gas turbine during low demand periods therefore also requires shutting down the associated auxiliary equipment, further increasing the costs associated with shutting down the gas turbine.

Another solution for operating a gas turbine during low demand periods is to operate the gas turbine under a turndown regime. In existing turndown regimes, the gas turbine still operates at the speed required to produce electricity at the desired frequency, and the flow rate of fuel and air to the combustors is reduced to reduce the amount of combustion gases generated in the combustors, thereby reducing the power produced by the gas turbine. However, the operating range of typical compressors limits the extent to which the air flow may be reduced, thereby limiting the extent to which the fuel flow may be reduced while maintaining the optimum fuel to air ratio. At lower operating levels, one or more nozzles in each combustor are "idled" by securing fuel flow to the idled nozzles. The fueled nozzles continue to mix fuel with the compressed working fluid for combustion, and the idled nozzles simply pass the compressed working fluid through to the combustion chamber without any fuel for combustion. The turndown regime produces sufficient combustion gases to operate the turbine and generator at the required speed to produce electricity with the desired frequency, and the idled nozzles reduce the fuel consumption. When the power demand increases, fuel flow may be restored to all nozzles to allow the gas turbine to operate again at the designed base load.

Existing turndown regimes are limited in the amount of power reduction that can be achieved. For example, the compressed working fluid passing through the idled nozzles in a turndown regime mixes with the combustion gases from the fueled nozzles and tends to prematurely quench the fuel combustion in the combustion chamber. The incomplete combustion of fuel generates increased CO emissions that may exceed emissions limits. As a result, the minimum operating level during existing turndown regimes may need to be as high as 40-50% design base load to comply with emissions limits for CO and NOx.

BRIEF DESCRIPTION OF THE INVENTION

Aspects and advantages of the invention are set forth below in the following description, or may be obvious from the description, or may be learned through practice of the invention.

In one embodiment of the present invention, a combustor includes an end cover and a combustion chamber downstream of the end cover. The combustor further includes a plurality of nozzles disposed radially in the end cover and a shroud surrounding at least one of the plurality of nozzles and extending downstream from the at least one of the plurality of nozzles into the combustion chamber. The shroud includes an inner wall surface and an outer wall surface.

In another embodiment of the present invention, a combustor includes an end cover and a combustion chamber downstream of the end cover. The combustor further includes a plurality of nozzles disposed radially in the end cover and a shroud surrounding at least one of the plurality of nozzles and extending downstream from the at least one of the plurality of nozzles into the combustion chamber. The shroud includes a double-walled tube.

A further embodiment of the present invention is a method for operating a combustor. The method includes flowing compressed working fluid through a plurality of nozzles into a combustion chamber and flowing fuel through each nozzle in a first subset of the plurality of nozzles into the combustion chamber. The method further includes igniting the fuel from each nozzle in the first subset of the plurality of nozzles in the combustion chamber. In addition, the method includes extending into the combustion chamber a separate shroud around each nozzle in a second subset of the plurality of nozzles and isolating fuel to each nozzle in the second subset of the plurality of nozzles.

Those of ordinary skill in the art will better appreciate the features and aspects of such embodiments, and others, upon review of the specification.

BRIEF DESCRIPTION OF THE DRAWINGS

A full and enabling disclosure of the present invention, including the best mode thereof to one skilled in the art, is set forth more particularly in the remainder of the specification, including reference to the accompanying figures, in which.

DETAILED DESCRIPTION OF THE INVENTION

Figure 1:
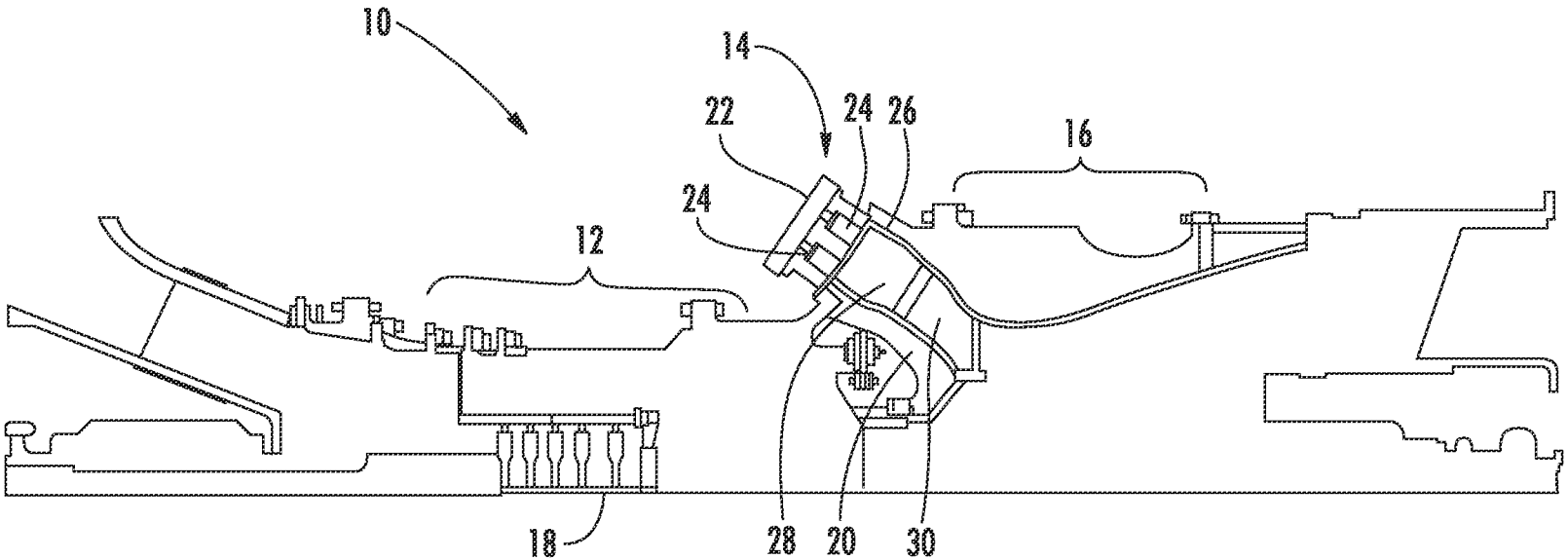
FIG. 1 shows a simplified cross-section of a gas turbine within the scope of the present invention.

Reference will now be made in detail to present embodiments of the invention, one or more examples of which are illustrated in the accompanying drawings. The detailed description uses numerical and letter designations to refer to features in the drawings. Like or similar designations in the drawings and description have been used to refer to like or similar parts of the invention.

Each example is provided by way of explanation of the invention, not limitation of the invention. In fact, it will be apparent to those skilled in the art that modifications and variations can be made in the present invention without departing from the scope or spirit thereof. For instance, features illustrated or described as part of one embodiment may be used on another embodiment to yield a still further embodiment. Thus, it is intended that the present invention covers such modifications and variations as come within the scope of the appended claims and their equivalents.

FIG. 1 shows a simplified cross-section of a gas turbine 10 within the scope of the present invention. The gas turbine 10 generally includes a compressor 12 at the front, one or more combustors 14 around the middle, and a turbine 16 at the rear. The compressor 12 and the turbine 16 typically share a common rotor 18.

The compressor 12 imparts kinetic energy to a working fluid (air) by compressing it to bring it to a highly energized state. The compressed working fluid exits the compressor 12 and flows through a compressor discharge plenum 20 to the combustors 14. Each combustor 14 generally includes an end cover 22, a plurality of nozzles 24, and a liner 26 that defines a combustion chamber 28 downstream of the end cover 22. The nozzles 24 mix fuel with the compressed working fluid, and the mixture ignites in the combustion chamber 28 to generate combustion gases having a high temperature, pressure, and velocity. The combustion gases flow through a transition piece 30 to the turbine 16 where they expand to produce work.

Figure 2:
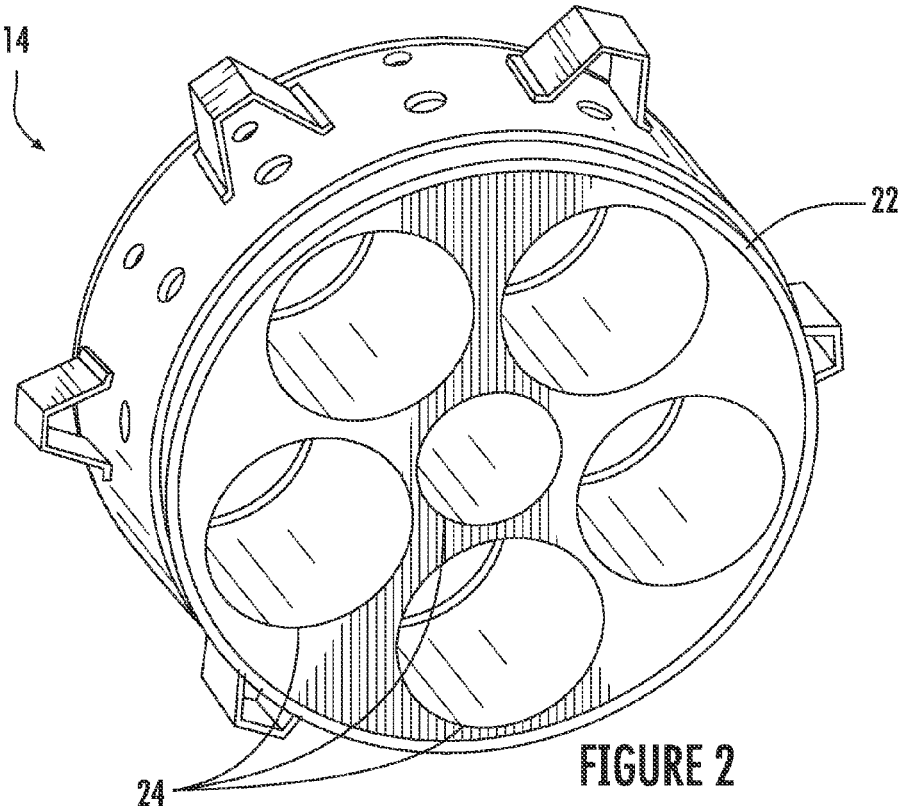
FIG. 2 shows a perspective view of the combustor shown in FIG. 1 with the liner removed for clarity.

FIG. 2 shows a perspective view of the combustor 14 shown in FIG. 1 with the liner 26 removed for clarity. As shown, the end cover 22 provides structural support for the nozzles 24. The nozzles 24 are generally arranged radially in the end cover 22 in various geometries, such as the five nozzles surrounding a single nozzle, as shown in FIG. 2. Additional geometries within the scope of the present invention include six or seven nozzles surrounding a single nozzle or any suitable arrangement according to particular design needs. The nozzles 24 may have uniform diameters or differing diameters, as illustrated in FIG. 2.

When operating at base load power, each nozzle 24 mixes fuel with the compressed working fluid. The mixture ignites downstream of the end cover 22 in the combustion chamber 28 to produce combustion gases. During periods of reduced power demand, the combustor 14 may be operated in a turndown regime in which one or more nozzles 24 are "idled" by securing fuel flow to the idled nozzles.

Figure 3:
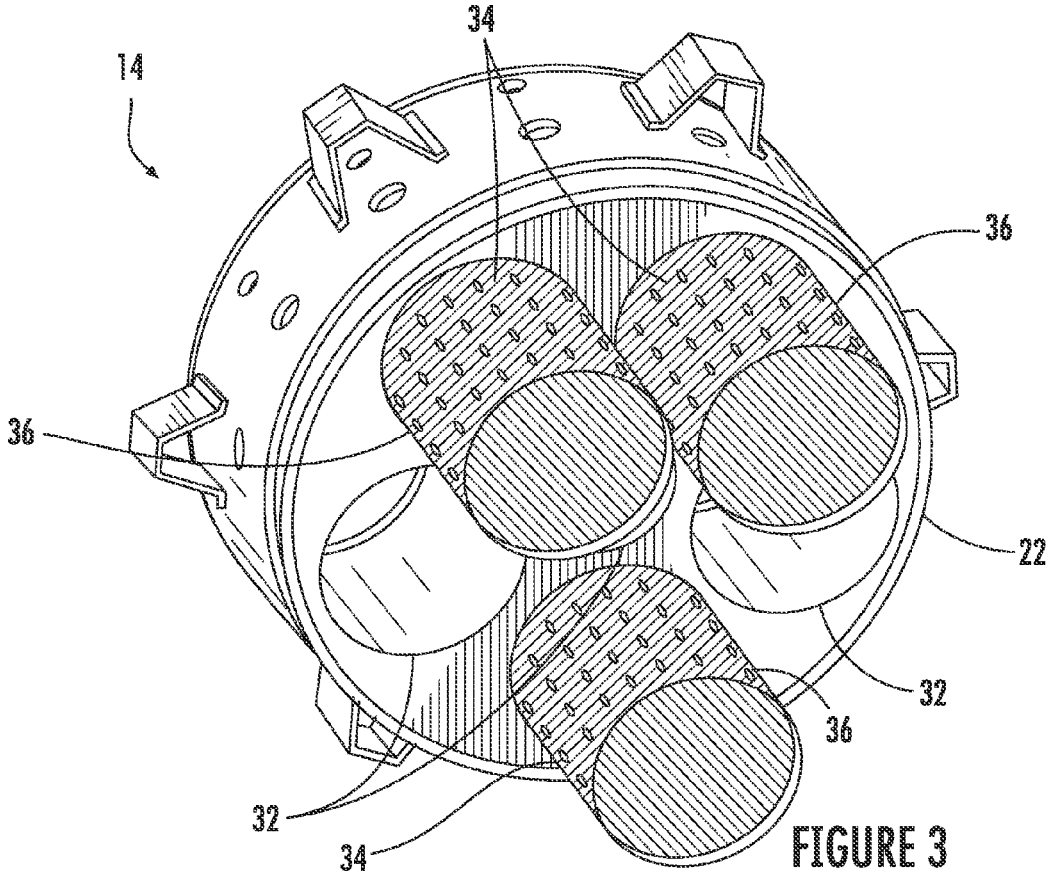
FIG. 3 shows a perspective view of the combustor shown in FIG. 2 being operated in a particular turndown regime.

FIG. 3 shows the combustor 14 shown in FIG. 2 being operated in a particular turndown regime. In this particular turndown regime, three nozzles are fueled nozzles 32, and three nozzles are idled nozzles 34. Fuel and compressed working fluid flow through the fueled nozzles 32, while only compressed working fluid flows through the idled nozzles 34. In addition, a shroud 36 surrounds each idled nozzle 34 and extends downstream from each idled nozzle 34 into the combustion chamber. The shrouds 36 may be fixedly or movably attached to the idled nozzles 34 and/or the end cover 22. Each shroud 36 guides the compressed working fluid through a portion of the combustion chamber to prevent the compressed working fluid from the idled nozzles 34 from prematurely quenching the combustion. When the power demand increases, the combustor 14 may return to base load power levels by restoring fuel flow to the idled nozzles 34 and igniting the fuel mixture in the combustion chamber.

Figure 4:
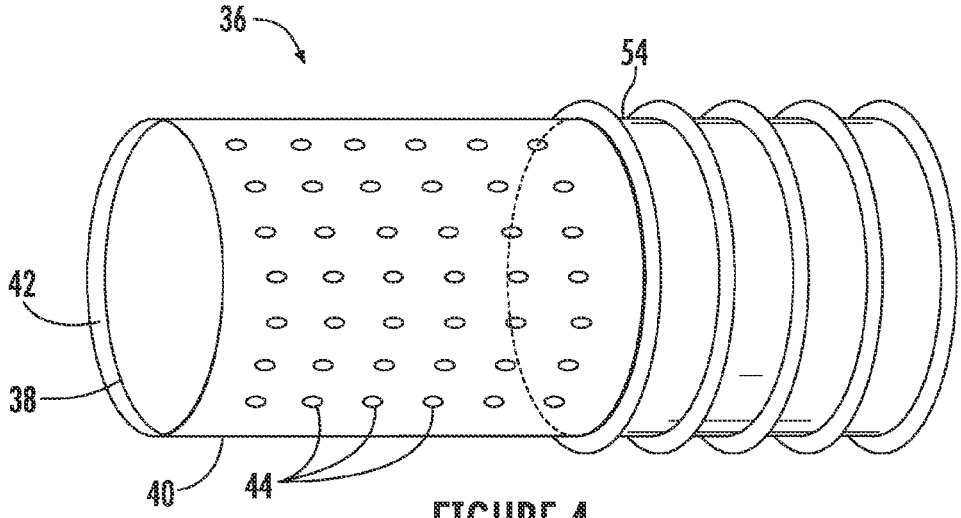
FIG. 4 shows a perspective view of the shroud shown in FIG. 3.

FIG. 4 shows a perspective view of the shroud 36 shown in FIG. 3. The shroud 36 may be made from any alloy, superalloy, coated ceramic, or other suitable material capable of withstanding combustion temperatures of more than 2,800-3,000 degrees Fahrenheit. The shroud 36 may be a double-walled construction with an inner wall surface 38 facing the associated idled nozzle, an outer wall surface 40 facing away from the associated idled nozzle, and a cavity 42 between the inner 38 and outer 40 wall surfaces. In alternate embodiments, the shroud 36 may be a single wall construction with the inner 38 and outer 40 wall surfaces being simply opposite sides of the single wall. Regardless of the construction, the shroud 36 may include a plurality of apertures 44 having a diameter between approximately 0.02 inches and 0.05 inches in either or both of the inner 38 and outer 40 wall surfaces.

A cooling fluid may be supplied through the cavity 42 and/or apertures 44 to cool the surfaces 38, 40 of the shroud 36. Suitable cooling fluids include steam, water, diverted compressed working fluid, and air. Other structures and methods known to one of ordinary skill in the art may be used to cool the shroud 36. For example, U.S. Patent Publication 2006/0191268 describes a method and apparatus for cooling gas turbine nozzles which may be adapted for use cooling shrouds as well.

Each shroud 36 has a slightly larger diameter than the associated idled nozzle and may be cylindrical in shape, as shown, or may have a convergent or divergent shape, depending on the particular embodiment and design needs. The length of the shroud 36 should be sufficient to extend the shroud 36 far enough into the combustion chamber to prevent the compressed working fluid from the idled nozzles from mixing with the combustion gases from the fueled nozzles and prematurely quenching the combustion. Suitable lengths may be 3 inches, 5 inches, 7 inches, or longer depending on the particular combustor design and anticipated turndown regime.

The shroud 36 shown in FIG. 4 may be retractable with respect to the end cover 22. If retractable, the shroud 36 is typically retracted during base load operations and extended during turndown operations when fuel is secured to the associated nozzle. As shown in FIG. 4, the shroud 36 may include a means for extending and retracting the shroud 36. The means for extending and retracting the shroud 36 may be any suitable manual, mechanical, electrical, hydraulic, pneumatic, or equivalent system known in the art for extending and retracting objects. For example, the shroud 36 may include a threaded extension 54, as shown in FIG. 4, that can be screwed into the end cover 22. The shroud 36 may be rotated manually or using an electric, hydraulic, or pneumatic motor. Rotation of the shroud 36 in one direction may extend the shroud 36 into the combustion chamber for turndown operations, and rotation of the shroud 36 in the other direction may retract the shroud 36 into the end cover 22 for base load operations. Other equivalent structures known in the art for extending and retracting objects include hydraulic pistons, pneumatic ratchets, springs, ratchet and pawl mechanisms, and magnetic or inductive coils.

FIGS. 5, 6, 7, and 8 illustrate fueled 32 and idled 34 nozzles in particular turndown regimes within the scope of the present invention. The shaded circles in each figure represent fueled nozzles 32, and the empty circles represent idled nozzles 34. A shroud 36, as shown in FIG. 4, surrounds each idled nozzle 34 and extends downstream from each idled nozzle 34 into the combustion chamber.

Figure 5:
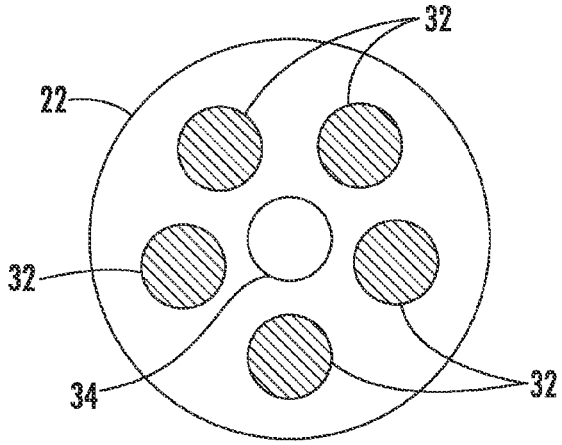
FIGS. 5, 6, 7, and 8 illustrate idled and fueled nozzles in particular turndown regimes within the scope of the present invention.
Figure 6:
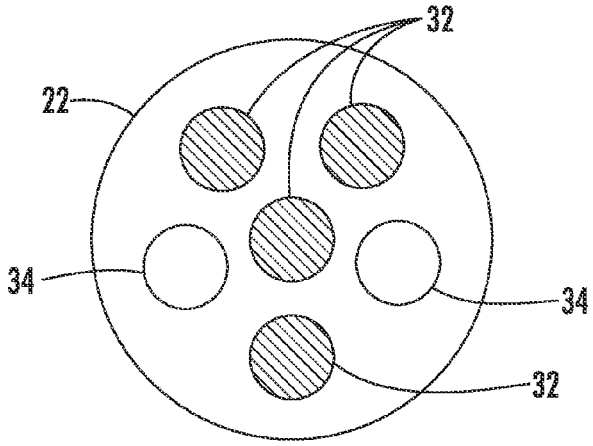
Figure 7:
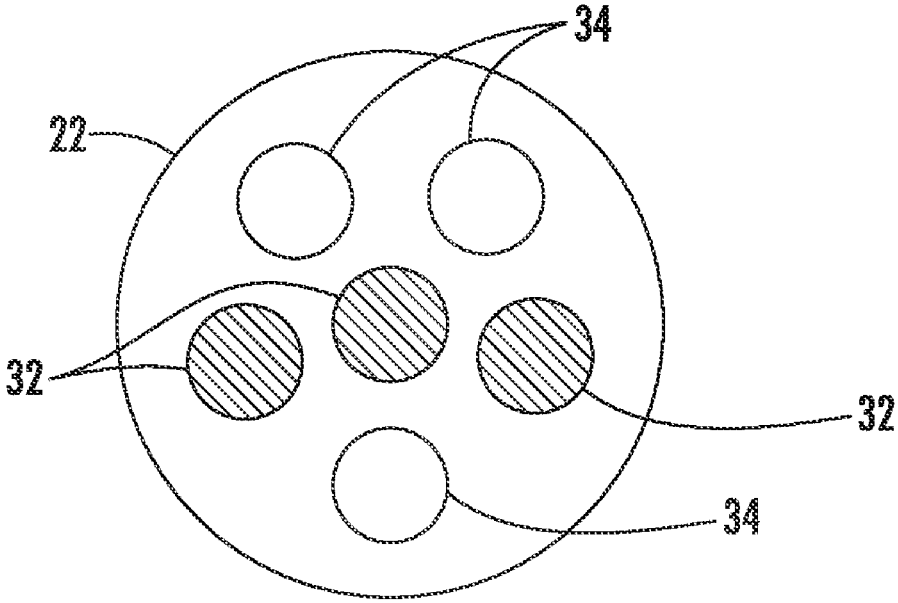
Figure 8:
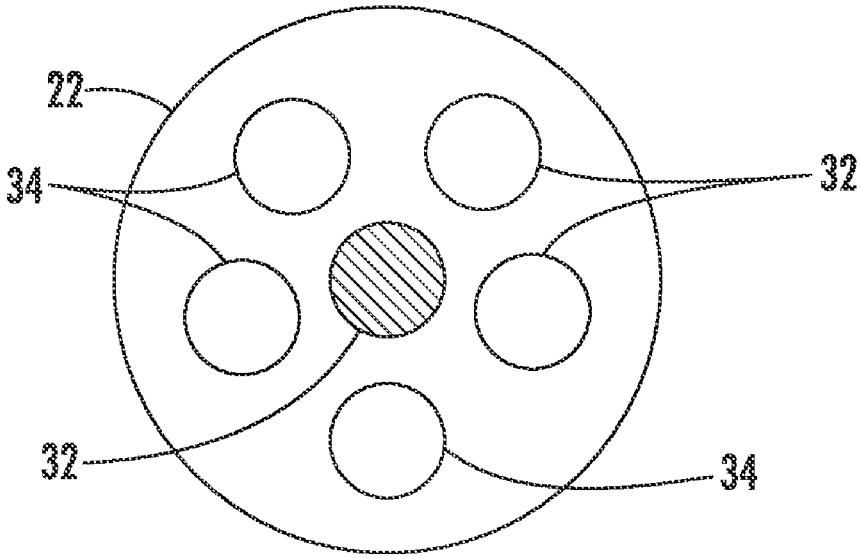

In FIG. 5, the five nozzles around the perimeter are fueled nozzles 32, and the center nozzle is an idled nozzle 34. In this turndown regime, the fuel consumption may be reduced by approximately 16%, and the combustion gas exit temperature may be reduced by as much as 70 degrees Fahrenheit without exceeding any emissions requirements. In FIGS. 6, 7, and 8, additional nozzles are idled to further reduce the power consumption during the turndown regime. In each turndown regime illustrated in FIGS. 5, 6, 7, and 8, compressed working fluid from the compressor flows through each nozzle 32, 34. In each illustration, a first subset of the nozzles are operated as fueled nozzles 32 and continue to receive fuel for combustion in the combustion chamber. In each illustration, a second set of nozzles are operated as idled nozzles 34 by securing the fuel flow to the idled nozzles 34 and surrounding each idled nozzle 34 with a shroud that extends downstream from the idled nozzles 34 into the combustion chamber.

A combustor within the scope of the present invention may be operated in a turndown regime as follows. A flow of compressed working fluid may be supplied through each nozzle into the combustion chamber. A flow of fuel may be supplied through a first subset of the nozzles (i.e., the fueled nozzles) into the combustion chamber and ignited in the combustion chamber. One or more shrouds may be extended around each nozzle in a second subset of the nozzles (i.e., the idled nozzles), and fuel may be isolated to each idled nozzle. If desired, each shroud may be cooled, for example, by flowing steam, water, diverted compressed working fluid, and/or air through apertures in each shroud.

The combustor may transition to design base load operations by flowing fuel through each idled nozzle into the combustion chamber and igniting the fuel from each previously idled nozzle in the combustion chamber. The shrouds may remain extended downstream from the previously idled nozzles into the combustion chamber. Alternately, the shrouds may be retracted from the combustion chamber.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A combustor, comprising:

a. an end cover;

b. a combustion chamber downstream of the end cover;

c. a plurality of nozzles disposed radially in the end cover; and d. a plurality of retractable shrouds, each retractable shroud surrounding a nozzle of the plurality of nozzles and extending downstream from the nozzle into the combustion chamber for turndown operations and retracting into the end cover for base load operations, wherein each retractable shroud includes an inner wall surface and an outer wall surface.

2. The combustor of claim 1, wherein each retractable shroud extends at least 5 inches downstream from the nozzle into the combustion chamber.

3. The combustor of claim 1, further including a plurality of apertures through at least one of the inner wall surface or the outer wall surface.

4. The combustor of claim 1, wherein each retractable shroud includes a cavity between the inner wall surface and the outer wall surface.

5. The combustor of claim 1, wherein each retractable shroud is fixed to the end cover.

6. The combustor of claim 1, further including means for extending and retracting each retractable shroud.

7. A combustor, comprising:

a. an end cover;

b. a combustion chamber downstream of the end cover;

c. a plurality of nozzles disposed radially in the end cover; and d. a plurality of retractable shrouds, each retractable shroud surrounding a nozzle of the plurality of nozzles and extending downstream from the nozzle into the combustion chamber for turndown operations and retracting into the end cover for base load operations, wherein each retractable shroud comprises a double-walled tube.

8. The combustor of claim 7, wherein each retractable shroud extends at least 5 inches downstream of the nozzle into the combustion chamber.

9. The combustor of claim 7, wherein each retractable shroud is fixed to the end cover.

10. The combustor of claim 7, wherein each retractable shroud includes a cavity in the double-walled tube.

11. The combustor of claim 7, further including a plurality of apertures through the double-walled tube.

12. The combustor of claim 7, further including means for extending and retracting each retractable shroud.

13. A gas turbine, comprising:

a. a compressor;

b. a combustor downstream from the compressor; and c. a turbine downstream from the combustor;

d. wherein the combustor comprises an end cover, a combustion chamber downstream of the end cover, a plurality of nozzles disposed radially in the end cover, and a plurality of retractable shrouds, each retractable shroud surrounding a nozzle of the plurality of nozzles and extending downstream from the nozzle into the combustion chamber for turndown operations and retracting into the end cover for base load operations, wherein each retractable shroud includes an inner wall surface and an outer wall surface.

14. The gas turbine of claim 13, wherein each retractable shroud extends at least 5 inches downstream from the nozzle into the combustion chamber.

15. The gas turbine of claim 13, further including a plurality of apertures through at least one of the inner wall surface or the outer wall surface.

16. The gas turbine of claim 13, wherein each retractable shroud includes a cavity between the inner wall surface and the outer wall surface.

17. The gas turbine of claim 13, wherein each retractable shroud is fixed to the end cover.

18. The gas turbine of claim 13, further including means for extending and retracting each retractable shroud.

* * * * *